United States Patent [19]

Perry

[11] Patent Number: 4,474,002

[45] Date of Patent: Oct. 2, 1984

[54] HYDRAULIC DRIVE PUMP APPARATUS

[76] Inventor: L. F. Perry, Rte. 3, Box 28, Olney, Tex. 76374

[21] Appl. No.: 271,974

[22] Filed: Jun. 9, 1981

[51] Int. Cl.[3] ..... F16D 31/00; F16D 31/02

[52] U.S. Cl. ..... 60/369; 60/381; 60/426; 60/448; 60/451

[58] Field of Search ..... 60/375, 369, 381, 374, 60/391, 428, 459, 484, 486, 444, 456, 464, 698, 425, 426, 427, 700, 447, 448, 449, 451; 417/374, 399; 91/196, 218; 74/589; 166/104

[56] References Cited

U.S. PATENT DOCUMENTS 2,200,790 5/1940 Eckert ..... 91/179

3,939,656 2/1976 Goldfein ..... 60/381

4,381,695 5/1983 Ogles ..... 60/369

*Primary Examiner*—Robert E. Garrett

*Assistant Examiner*—John M. Husar

*Attorney, Agent, or Firm*—Robert M. Hessin

[57] ABSTRACT

A hydraulic drive apparatus for a wellhead pump jack which utilizes oppositely driven single-acting hydraulic cylinders as actuated by a variable volume pump having flow direction and flow volume controlled by a servo linkage and control lever. The linkage transmits oscillatory sine function motion of the walking beam for movement of the control lever as intermediate biasing force prevents nulling of the system.

5 Claims, 2 Drawing Figures

HYDRAULIC DRIVE PUMP APPARATUS

BACKGROUND OF THE INVENTION

1. Field of the Invention

The invention relates generally to hydraulically driven pump jacks and, more particularly, but not by way of limitation, it relates to an improved form of servo-controlled hydraulic drive system as may be utilized on an oil well pumping unit.

2. Description of the Prior Art

The prior art includes numerous types of drive systems for use in actuation of walking beam types of pumping units. Earlier types employed a fuel-driven engine and crank linkage to move the walking beam in an up/down pumping motion, and it has been attempted to use direct electric motor drive but with much loss in power efficiency. More recently, a number of systems have evolved which utilize hydraulic power to reciprocate the walking beam. In general, these units use a valving system which alternates from full open to closed, and many problems are encountered due to the fact that drive power is not controlled in accordance with the sine function of pump head movement. U.S. Pat. No. 4,201,115 teaches an oil well pump jack with dual hydraulically operated piston and cylinder assemblies controlling movement of the walking beam. This patent teaches the use of a mechanical linkage from the walking beam to provide servo input through a reversing valve thereby to effect reciprocal energization to drive the walking beam.

U.S. Pat. No. 3,939,656 teaches yet another form of servo-feedback structure in order to provide reversing fluid circulation to a double-acting hydraulic cylinder which drives the walking beam. The servo system of this teaching requires additional hydraulic circuitry and double-acting control cylinder in order to effect synchronous reciprocation as controlled by a variable displacement reversing swashplate pump that is driven at a predetermined constant speed. Finally, U.S. Pat. No. 3,175,513 deserves mention in that it discloses a hydraulic pumping unit that has a reciprocal rate control means. A sliding weight on the walking beam is controlled by a hydraulic cylinder in order to balance the rate of the walking beam optimally during its rocking action.

SUMMARY OF THE INVENTION

The present invention relates to improvements in construction of a hydraulically driven pump jack wherein a mechanical servo linkage is connected directly to a variable volume hydraulic pump thereby to maintain pump pressure reciprocation, and therefore pump head movement, at proper speed. The pump is pivotally affixed on a stanchion and base assembly and is reciprocally driven by forward and rearward hydraulic cylinders which are pressurized in alternate sequence to oscillate the walking beam about a horizontal axis. A feedback control linkage is connected from the walking beam pivot point to a torque motor driven rotor which, in turn, is mechanically connected to a control lever of a variable volume pump as driven by a prime mover.

Therefore, it is an object of the present invention to provide a more consistent feedback control for use in a reciprocating hydraulic drive system.

It is also an object of the present invention to provide a hydraulic drive and control system which utilizes alternating hydraulic fluid flow in direct proportion with walking beam cyclical motion.

It is still further an object of this invention to provide a hydraulic drive system for pump jacks which is not affected by the viscosity of the hydraulic fluid.

Finally, it is an object of the present invention to replace the conventional gearbox linkage with a hydraulic drive unit and servo-control system thereby to provide a more reliable and power-efficient oil well pump jack.

Other objects and advantages of the invention will be evident from the following detailed description when read in conjunction with the accompanying drawings which illustrate the invention.

DETAILED DESCRIPTION OF THE INVENTION

Figure 1:
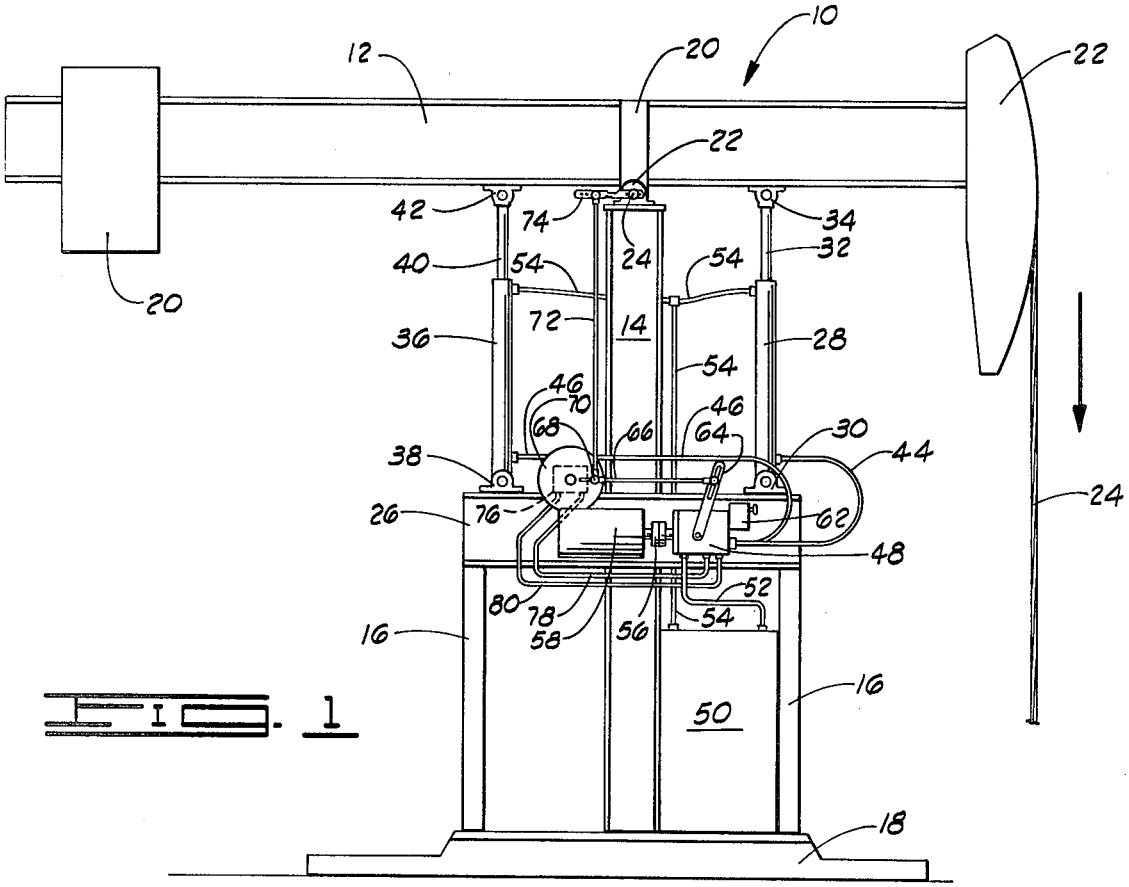
FIG. 1 is a view in side elevation of a pump jack constructed in accordance with the present invention.

Referring to FIG. 1, an oil well pump jack 10 consists of a walking beam 12 pivotally supported on a samson post 14 that is further supported by a frame 16 and base 18. A counterweight 20 is adjustably secured on one end of walking beam 12 while the other end terminates in affixure to a horse's head 22 carrying a connector cable 24. Connector cable 24 then connects through the polish rod to the sucker rod assembly (not shown) in well-known manner.

A pivot member 20 of walking beam 12 is pivotally supported in a clevis bearing 22 by means of a pivot pin 24. Clevis bearing 22 is then rigidly secured on samson post 14 as it is rigidly supported from earth-engaging base 18 and frame 16. Frame 16 includes a horizontal channel structure 26 thereacross to provide transverse support for the power assembly. Thus, a single-acting hydraulic cylinder 28 is pivotally secured to a clevis bearing 30 secured on support member 26 while extending a rod end 32 into pivotal engagement with a clevis bearing 34 secured beneath the forward area of walking beam 12. In like manner, the rearward side of walking beam 12 is engaged by hydraulic cylinder 36 pivotally supported by clevis bearing 38 to extend a rod end 40 into pivotal engagement with a clevis bearing 42.

Figure 2:
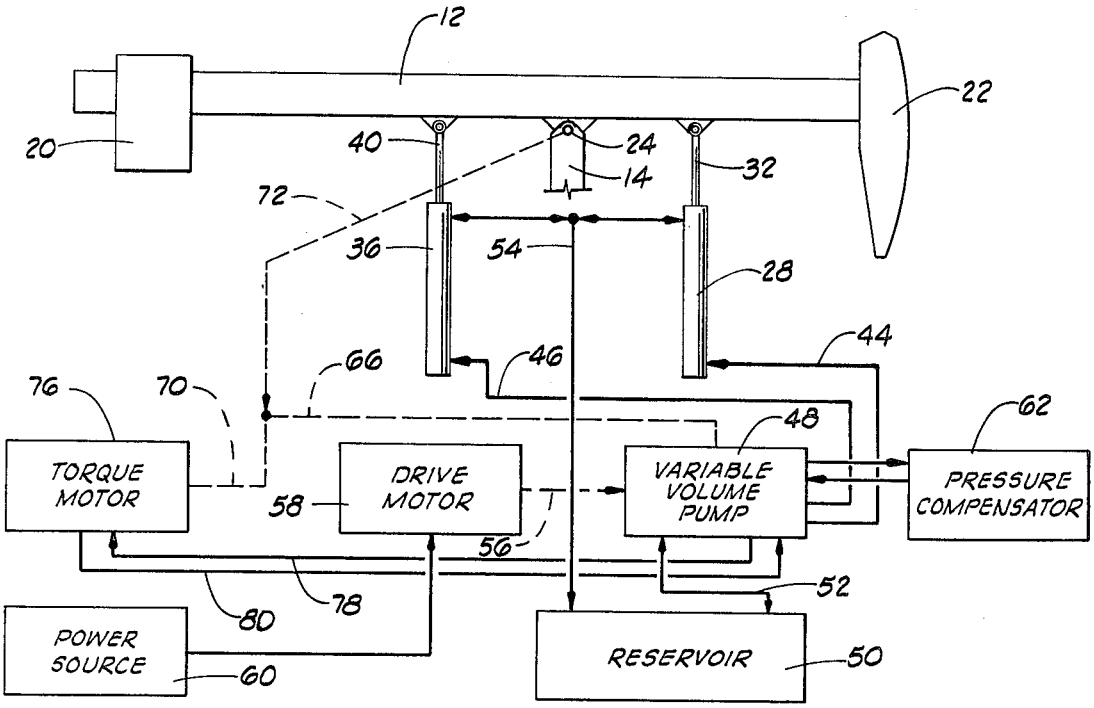
FIG. 2 is a schematic illustration of the pump jack and drive system of FIG. 1.

Referring also to FIG. 2, the hydraulic cylinders 28 and 36 are alternately oppositely energized by hydraulic fluid input or withdrawal in respective conduits 44 and 46 leading from a variable volume pump 48. Hydraulic fluid is supplied from a reservoir 50 via conduit 52 to the pump 48, and return fluid flow from either of cylinders 28 and 36 is via return conduit 54 to the supply reservoir 50. The variable volume pump 48 in present design is a controlled stroke piston pump, a Denison Hydrastatic Transmission Pump, and the size and capacity are selected in accordance with the design criteria for specific sizes of pump jacks.

The variable volume pump 48 is energized through a rotational coupling 56 by a selected size of electric motor 58. Electric motor 58, e.g. a forty horsepower motor, may be any type that is compatible with the available local power source; however a gasoline fueled engine could be utilized if desired. A pressure compensator 62 is connected to pump 48 to provide automatic adjustment for the swash plate; that is, pressure compensator 62 may be adjusted to a preselected high limit pressure value at which point it will destroke.

The fluid volume and flow direction as between conduits 44 and 46 is controlled by the angular disposition of a control lever 64. Thus, (as shown) positioning of control lever 64 at about 30° either side of vertical represent the maximum opposed flow volumes from pump 48, and the center or vertical position places the pump in a no-flow condition. As shown in FIG. 1, the output fluid volume from pump 48 is limited to about 20° either side of vertical, and this adjustment of maximum limits may be carried out by adjustment of the length of control linkage 66 as pivotally connected to a rotary post 68 disposed on a synchronization disk 70. Also secured to rotary post 68 is a vertical linkage 72 which is adjustably affixed to a synchronizing lever 74 that is secured for movement with pivot pin 24 and, therefore, walking beam 12.

The synchronizing disk 70 is rotatably driven by a torque motor 76 to provide continual biasing of control lever 64 through the null or zero flow positions, i.e. when head 22 is at extreme upward or downward excursion. Torque motor 76 is energized by hydraulic lines 78 and 80 as connected to a constant pressure supply output that is provided in the variable volume pump 48. In present design, the torque motor 76 is a Char-Lynn Hydraulic Torque Motor that is characterized by operation at high torque and low rpm output.

In operation, the pump jack 10 is positioned at a well site and connected to a suitable primary power source 60. Output from power source 60 is then applied continually to drive motor 58 which, in turn, provides a rotational input 56 to the variable volume pump 48. Variable volume pump 48 provides alternating opposite variable fluid pressure on lines 44 and 46 to alternately oppositely actuate respective hydraulic cylinders 28 and 36. That is, fluid pressure or incrementally adjusted volume of flow as controlled by angular disposition of control lever 64 will be in opposite directions in lines 44 and 46 at all times of pressure differential other than the vertical or zero flow position of lever 64; but, directions of flow are reversed as control 64 moves to the opposite quadrant. Hydraulic fluid in the upper sectors of cylinders 28 and 36 communicating with return conduit 54 to reservoir 50 serves as lubricant and exerts no operative pressure differential. The variable volume pump 48 also provides a constant pressure fluid supply by line 78 to energize the torque motor 76, fluid return being by line 80 to the variable volume pump 48.

Control lever 64 of pump 48 is actuatable through about 20° (as adjusted FIG. 1) either side of vertical, i.e. from maximum fluid volume output on line 46 and intake on line 44 through vertical or zero flow setting to maximum fluid volume output on line 44 and intake on line 46. On either side of vertical, the amount of angular deviation of control lever 64 is proportional to the volume of fluid flow in that direction. The position of control lever 64 is controlled directly from linkage 66, synchronizing disk 70, linkage 72 and pivot lever 74. Thus, the servo-control linkage from pivot lever 74 to control lever 64 provides position feedback which enables control of cylinders 28 and 36 so that walking beam 12 moves in a sine function with greatest speed in the horizontal attitudes and lesser speed down to zero at the upward and downward end of stroke.

As shown in FIG. 1, walking beam 12 is in horizontal attitude traveling at fastest speed with maximum fluid output and intake from pump 48 to extend cylinder 36 and retract cylinder 28. In this maximum downward speed, the rotary post 68 on disk 70 is moving counterclockwise under control of linkage 72 and pivot levers 74. The horse head 22 gets to its lowermost position, and pivot lever 74 is at its uppermost position, disk 70 will have revolved one quarter revolution placing rotary post 68 at its uppermost position with control lever 64 moved leftward into the vertical of zero position. In order to avoid complete nulling out of the drive system at this zero position, torque motor 76 functions to bias or urge disk 70 in the counterclockwise direction while increasing the leftward position of control lever 64 and, accordingly, the increase of reversed fluid flow drives horse head 22 to its upper most position in the harmonic stroke sequence. Thus, initial movement of walking beam 12, as effected by torque motor 76, continues reciprocation of control lever 64 back and forth through its zero position and linkage 72 and pivot lever 74 provide continual position feedback from walking beam 12 to the drive assembly.

The foregoing discloses a novel form of servo-control drive system for a hydraulic pump jack. The servo-control system of the present invention is characterized by a mechanical structure which is reliable yet relatively inexpensive and rugged in usage. While the present invention is described with respect to an electrical energy power source, it should be understood that any of the conventional rotary drive generating systems may be utilized to effect operation of the hydraulic drive system.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Wellhead pump jack apparatus comprising:

a pump jack assembly including a walking beam pivotally mounted on a Sampson post supported by a frame and earth-engaging base assembly;

first and second hydraulic cylinders connected between the frame and walking beam on opposite sides of the Sampson post;

fluid supply means;

variable volume pump means receiving input from said fluid supply means and having a control lever operable reciprocally to control fluid output pressure alternately between first and second outputs connected to respective first and second hydraulic cylinders;

primary power means providing rotational drive input to said pump means;

linkage means including a vertical linkage connected through a synchronizing disk to a control linkage, said linkage means being connected to transfer reciprocal movement of said walking beam to similar reciprocal movement of said pump means control lever;

hydraulic torque motor means connected to said synchronizing disk;

and a constant pressure fluid supply from said variable volume pump means providing constant speed and drive power to said torque motor means to apply an additional reciprocal movement force preventing the pump means control lever from nulling at the reciprocal mid-point of zero fluid pressure output.

2. Apparatus as set forth in claim 1 which further includes:

pressure compensator means in interconnection with said variable volume pump means.

3. Hydraulic drive apparatus for a wellhead pump jack having an earth engaging base and frame supporting a vertical Sampson post which is connected to a walking beam at a generally central position by means of a pivot assembly that enables oscillating vertical movement of the walking beam relative to a horizontal plane, comprising:

first and second extensible hydraulic cylinders connected between said walking beam and said frame on opposite sides of said Sampson post;

fluid supply means;

variable volume pump means connected to said fluid supply means and having first and second conduits connected to said first and second hydraulic cylinders and including control lever means for proportionately alternating intake and output fluid pressure between said first and second conduits;

primary power means rotatively driving said pump means;

pivot means connected to said pivot assembly to reciprocate in parallel disposition with said walking beam;

linkage means including vertical link, a rotary disk, and a second link, said linkage means being connected to transfer the reciprocal movement of said pivot means to said pump means control lever; and a hydraulic torque motor driven by constant pressure fluid output from said variable volume pump means to provide rotational drive to said rotary disk thereby to bias said control lever and avoid nulling of drive system.

4. In a hydraulic pump jack apparatus of the type having a base frame and Sampson post supporting an oscillating walking beam as driven by reciprocating single-acting first and second hydraulic cylinder operating in opposed phase, a servo-control drive apparatus, comprising:

pivot means connected to reciprocate in parallel with said walking beam;

fluid supply means;

variable volume pump means connected to said fluid supply means and having first and second output conduits connected to respective ones of said first and second hydraulic cylinders, and including control lever means for proportionately alternating intake and output fluid pressure between said first and second output conduit;

linkage means, including a first link, rotary disk and a second link, connected to transfer the reciprocal movement of said pivot means to said pump means control lever; and a hydraulic torque motor providing rotational drive to said rotary disk to provide a bias force to said control lever thereby to avoid nulling of the drive system.

5. Apparatus as set forth in claim 4 wherein said pivot means comprises:

lever means connected to reciprocate in parallel with said walking beam.

* * * * *